United States Patent [19]

Ogawa

[11] Patent Number: 4,573,942

[45] Date of Patent: Mar. 4, 1986

[54] MOTOR VEHICLE WITH ELONGATION MEANS AND MOVABLE EXHAUST

[75] Inventor: Iwakichi Ogawa, Kashiwa, Japan

[73] Assignee: Takara Co. Ltd., Tokyo, Japan

[21] Appl. No.: 524,522

[22] Filed: Aug. 17, 1983

[30] Foreign Application Priority Data

Sep. 30, 1982 [JP] Japan ..... 57-148146
Nov. 1, 1982 [JP] Japan ..... 57-164560[U]

[51] Int. Cl.[4] ..... A63H 29/00
[52] U.S. Cl. ..... 446/457; 446/437
[58] Field of Search ..... 446/6, 457, 431, 437, 446/459, 461, 462–464

[56] References Cited

U.S. PATENT DOCUMENTS 3,300,894 1/1967 Glass et al. ..... 446/435
4,244,144 1/1981 Goldberg et al. .
4,393,620 7/1983 Murakami .

*Primary Examiner*—F. Barry Shay
*Attorney, Agent, or Firm*—Price, Gess & Ubell

[57] ABSTRACT

A toy motorized vehicle which can be reconfigured into a longer, racier-looking vehicle with raised exhaust pipes. The reconfiguration takes place automatically while the car's motor is driving it over a supporting surface.

4 Claims, 10 Drawing Figures

MOTOR VEHICLE WITH ELONGATION MEANS AND MOVABLE EXHAUST

BACKGROUND OF THE INVENTION

1. Field of the Invention

The present invention relates to a running toy which contains a spring powered prime mover and more particularly to a vehicle toy having the ability to reconfigure the toy body when the toy is driven.

2. Description of the Prior Art

In running toys having a prime mover consisting of gearing capable of driving wheels with a spring as a power source, energy is stored in the spring by rotating the driving wheels by rearwardly moving the toy body and then, when the hand is removed from the toy body, the energy stored in the spring causes the driving wheels to rotate, thereby allowing the toy to be self-propelled.

Although such a running toy permits various kinds of play, there is generally no change in the actual configuration of the toy.

SUMMARY OF THE INVENTION

An object of the invention is to provide a toy vehicle which can be reconfigured such that the toy body is maintained in a locked state while storing energy, but is released to elongate or change its configuration when the toy is driven to change the position of simulated motor exhaust pipes.

An embodiment of the invention will be described hereunder with reference to the accompanying drawings.

DESCRIPTION OF THE PREFERRED EMBODIMENT

Figure 1:
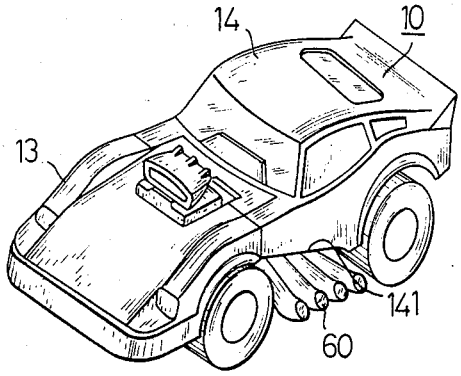
FIG. 1 is a perspective view of an embodiment of the running toy in accordance with the invention.
Figure 2:
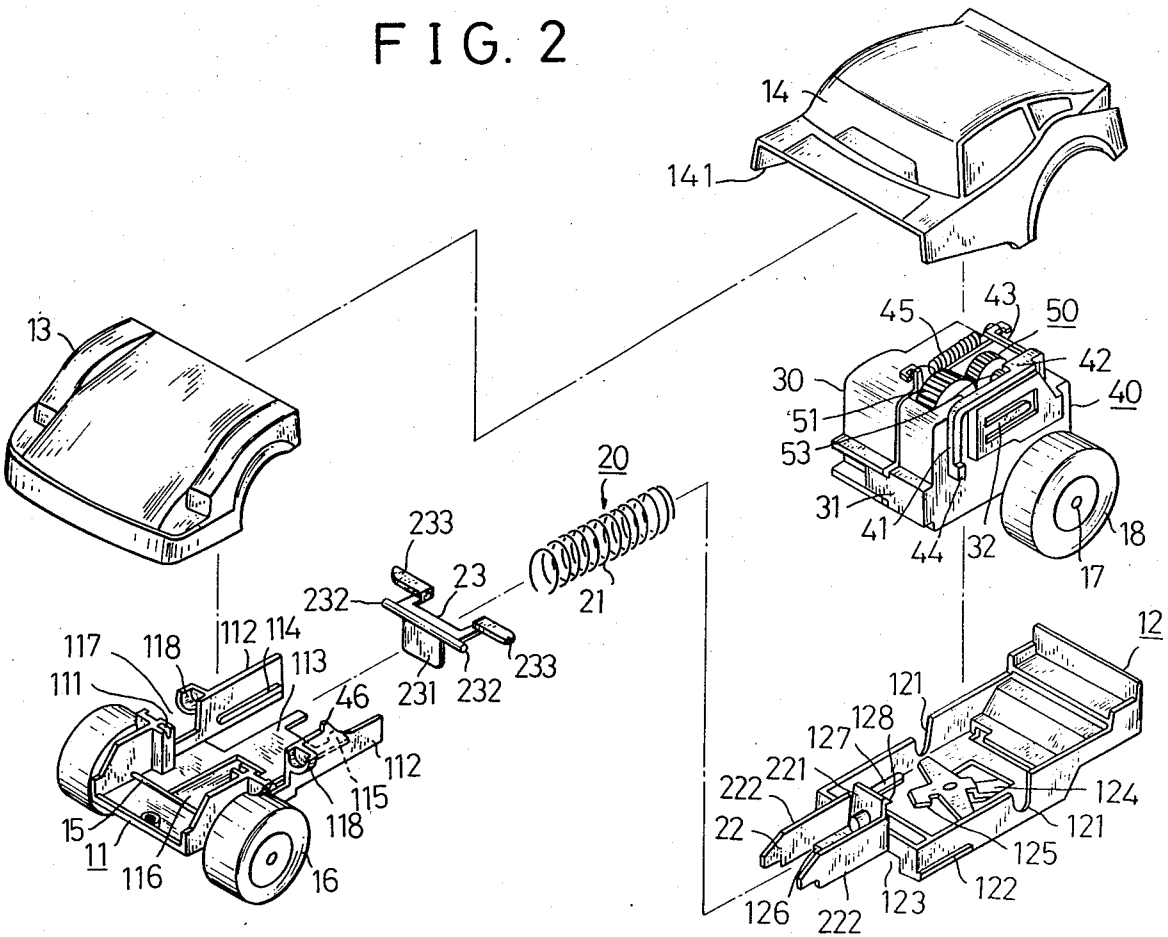
FIG. 2 is an exploded perspective view of the embodiment of FIG. 1.

FIGS. 1 and 2 are respectively, a perspective view and exploded perspective view of an embodiment of the running toy in accordance with the invention. Shown in the Figures is an example of the running toy in accordance with the invention as applied to a toy car. The toy car comprises a toy body 10 divided into front and rear portions, an urging means 20 fitted in the toy body 10 for urging the body 10 so that the latter can be longitudinally elongated. A prime mover 30 mounted on the rear side of the body 10. A lock means 40 for locking the body so as to prevent any change in configuration until released from the urging means 20, and a lock releasing means 50 interlocked with the prime mover 30 for releasing the lock effected by the lock means 40 when the toy is driven to run. It is to be noted that although the prime mover 30 is disposed on the rear side in this embodiment, the prime mover 30 may be disposed on the front side of the vehicle.

The toy body 10, having a configuration which simulates a car, has lower frame members 11, 12, and housing members 13, 14 attached to the corresponding lower frame members 11, 12. The front and rear lower frame members 11, 12 are connected together by elongatably fitting them into each other. The front lower frame member 11 supports an axle 15, to which front wheels 16 are rotatably attached. The rear lower frame member 12 has on both side surfaces notches 121 for receiving an axle 17. Although rear wheels 18 are attached to the prime mover 30, described later, the rear wheels 18 may also be attached to the rear lower frame member 12. In addition, a spring housing portion 22 for housing the spring of the urging means 20, to be described later, is projected from the front end of the rear lower frame member 12. Moreover, a bearing 111 for supporting a spring retaining member 23, corresponding to the spring housing portion 22, is provided, one on each side surface near the axle 15 on the front lower frame member 11.

The front lower frame member 11 has, as connecting portions with the rear lower frame member 12, a bottom plate 113 as well as right and left side plates 112. Each side plate 112 has on its inner side a locking elongated protrusion 114 for checking any upward movement of the connecting portion of the rear lower frame member 12, to be described later. In addition, the bottom plate 113 has at its front end a hook engaging portion 115 to engage a hook 125 of the rear lower frame member 12 thereby to check any unwanted elongation. Moreover, the front lower frame member 11 has near the axle 15 a lock groove 116 for effecting a lock action so that the connection between the front and rear lower frame members 11, 12 will not be undone when the body 10 is elongated or transformed.

On the other hand, the rear lower frame member 12 has as connecting portions, support projections 222 extended from right and left side surfaces thereof to slide on the lower surfaces of the side plates 112, for supporting the same, together with an opening 123 formed in the lower part of the spring housing portion 22 for receiving the bottom plate 113. In addition, the rear lower frame member 12 has in its central part a locking hook 125 which is integrally formed with a changeover lever 124 projecting toward the lower surface side thereof through a through-hole. The hook 125 is pivoted by the lever 124 so as to engage the hook engaging portion 115. Moreover, a lock pawl 126 to engage the lock groove 116 is provided in the central lower part of the spring housing portion 22. It is to be noted that a spacer 127 is provided on the inner side of each side surface for supporting a frame 31 of the prime mover 30, described later, in order to ensure a space for receiving the bottom plate 113.

The urging means 20 fitted in the body 10 comprises a spring 21 constituted by a coiled spring, the spring housing portion 22 provided on the rear lower frame member 12, and the spring retaining member 23 attached to the front lower frame member 11. The spring housing portion 22 is constituted by a spring retaining piece 221 which contacts and secures one end side of the spring 21, and support pieces 222 on the side surfaces thereof. The spring retaining member 23 comprises a spring retaining piece 231 which contacts the other end of the spring 21, shafts 232 fitted in the bearings 111 respectively for rotatably supporting the spring retaining member 23, and pressing pieces 233 provided substantially perpendicular to the spring retaining piece 231 for pressing the base portions of exhaust pipes, described later. In the preferred embodiment, the spring retaining member 23 has such a construction as described above in order to provide the function of making the exhaust pipes 60 vertically move in addition to assisting the elongation of the body 10. When no additional function is required, however, it suffices to project the spring retaining piece 231 directly from a proper position on the bottom surface of the front lower frame member 11.

The prime mover 30 to be mounted on the rear lower frame member 12 is formed by fitting a spring and a gearing assembly (neither of them are shown) in the frame 31. In addition, the axle 17, linked with the gearing, is rotatably and horizontally carried at a proper position in the lower part of the frame 31, and the rear wheels 18 are attached to the axle 17. When the rear wheels 18 are forcibly rotated in a retraction direction for the body 10, the spring is wound through the gearing to store energy; when the rear wheels 18 are set free, the spring rotates the rear wheels 18 through the gearing, whereby the toy body 10 is made to travel. It is to be noted that the frame 31 is adapted to house also a lock releasing means 50, described later.

Figure 3:
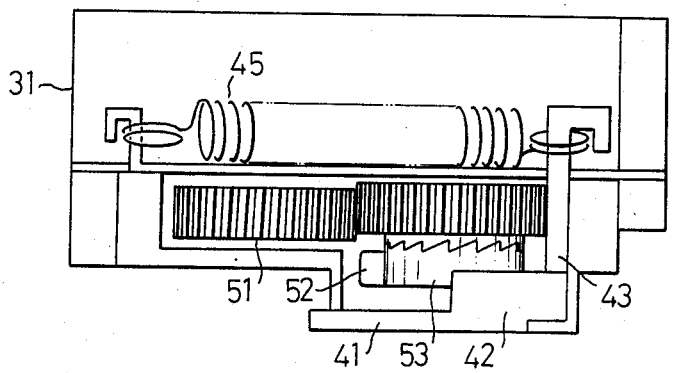
FIG. 3 is an enlarged plan view of an example of a lock means and a lock releasing means employed in the embodiment of FIG. 1.

The lock means 40 for locking the toy body 10 comprises, as shown in FIG. 3, a lock arm 41 pivotably supported at a proper position on a side part of the frame 31, a spring 45 having one end thereof secured at a proper position on the frame 31 for urging the lock arm 41 to maintain a locked state, and a lock projection 46 projected from a proper position on the side plate 112 of the front lower frame member 11 for engagement with an end 44 of the arm 41. The lock arm 41 is formed into a substantially L shape, and has its proximal end pivotably attached to the frame 31. In addition, an abutment piece 44 against which a cam of the lock releasing means 50 abuts and a connecting piece 43 to which the movable end of the spring 45 is connected are provided on the side of the bent portion of the arm 41 closer to the frame 31. The spring 45 urges the lock arm 41 to pivot in the counterclockwise direction as viewed in FIGS. 5*a* and 5*b*. When the front lower frame member 11 and the rear lower frame member 12 are fitted with each other, the arm 41 automatically pivots, causing the end 44 and the lock projection 46 to engage each other, and the engagement is maintained as it is. It is to be noted that the lower surface side of the end portion of the abutment piece 42 is tapered so that when the lock is released the cam will slidabley contact the lower surface of the abutment piece 42 and can easily push up the same.

The lock releasing means 50 acting on the lock means 40 comprises, as shown also in FIG. 3, a gear device 51 provided in the frame 31 adjacent to the prime mover 30 for deriving power from a part of the gearing of the prime mover 30, a cam 52 pivoted by means of the gear device 51 to push up the abutment piece 42 of the lock arm 41, and a one-way clutch 53 on the follower side, the cam 52 may be formed separately. The cam 52 is disposed so as to abut against the underside of the abutment piece 42 during the storing energy by the spring, and against the distal end side of the abutment piece 42 when the toy is driven to run, thereby making a difference between the torque applied on the lock arm 41.

In storing energy in the spring, the cam 52 abuts against the abutment piece 42 and is locked; hence, the follower side of the one-way clutch 53 slides and the engagement thereof is undone. Accordingly, when no more rotational force is applied to the cam 52, it is locked in this state and will not push up the lock arm 51. At this time, the follower-side end portion of the clutch 53 is urged to return into the engaging state by means of a spring piece 32 provided on a side surface of the frame 31. When the toy is driven to run, since the engagement of the one-way clutch 53 is not undone, the clutch 53 applies the power from the gear device 51 to the cam 52, causing the same to pivot. Upon receiving this pivoting force, the cam 52 presses the abutment piece 42 to push up the lock arm 41. The timing can be properly set by selecting the gear ratio of the gear device 51.

It is to be noted that although in the preferred embodiment, the one-way clutch is employed as means for transmitting only the rotational motion in one direction, other means, e.g., a ratchet, may be employed.

An example of the assembly of the running toy of the invention will be described hereinunder.

First of all, the axle 15 is horizontally mounted on the front lower frame member 11, and the front wheels 16 are attached to the axle 15. Then, the shafts 232 of the spring retaining member 23 are pivotably fitted in the bearings 111, and the front housing member 13 is attached to the upper part of the front lower frame member 11 by means of screwing or other means. The front housing member 13 has a part thereof abutting against the pressing pieces 233 of the spring retaining member 23 in order to prevent the pressing pieces 233 from any upwardly displacement motion.

On the rear lower frame member 12, the prime mover 30, having the frame 31 provided with the lock means 40 and the lock releasing means 50 and the rear wheels 18 attached thereto, is mounted and secured by means of a lock pawl 128 and the rear housing member 14 is attached thereonto by means such as a screw.

Figure 4:
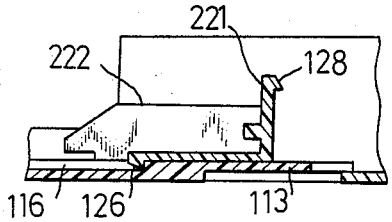
FIG. 4 is a sectional view particularly showing the connected state of the front and rear lower frame members.
Figure 5A:
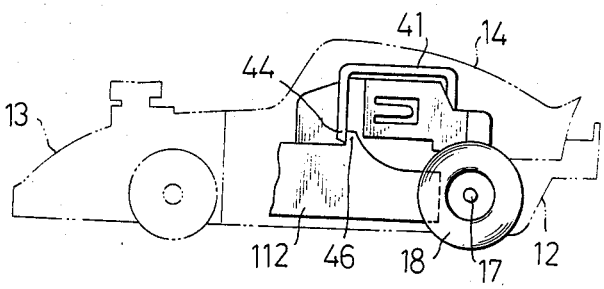
FIG. 5A is a side elevational view showing the vehicle body in a locked position.

Next, the spring 21 is fitted in the spring housing portion 22, which is then mounted on the bottom plate 113 of the front lower frame member 11. The front and rear lower frame members 11, 12 are brought close to each other. More-over, the bottom plate 113 is inserted into the opening 123 of the rear lower frame member, and the side plates 112, are mounted on the respective support projections 122. The lower frame members 11, 12 are pushed toward each other until the lock pawl 126 engages the lock groove 116, thereby to attach the lower frame member 11, 12 with each other (see FIG. 4). Under this state, the body 10 is elongated, i.e., the front and rear portions of the body are relatively displaced from each other. Therefore, the lower frame members 11, 12 are further pressed against the pressure of the spring 21 until the front and rear portions contact each other. At this time, the spring 21 is compressed. In addition, the lock arm 41 of the lock means 40 is urged by the spring 45, so that the end 44 engages the lock projection 46 on the side of the front lower frame member 11 thereby to lock the body 10 so as not to elongate, as shown in FIG. 5A.

The operation of the running toy of the invention assembled as described above will now be explained.

Figure 6A:
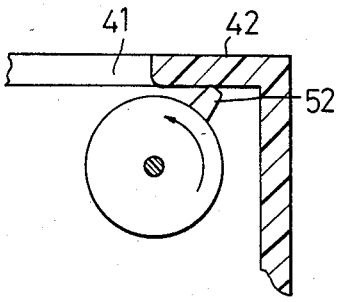
FIGS. 6A and 6B are enlarged sectional views showing the relationship between a cam and a lock arm, respectively.

First, the toy body 10 is held by the hand and rearwardly moved on a traveling surface to rotate the rear wheels 18 to store energy in the spring of the prime mover 30. At this time, in the lock releasing mechanism 50, the cam 52 is slightly pivoted by the rotation of the gear device 51 to abut against the base portion of the abutment piece 42 of the lock arm 41. Here, the gear device 51 attempts to further pivot the cam 52. However, since the engagement of the one-way clutch 53 interposed therebetween is released the cam 52 is held in this state of abutment against the abutment piece 42 and hence will not push up the lock arm 41. Accordingly, the body 10 is maintained in the locked state where it cannot elongate (see FIG. 6A).

Figure 6B:
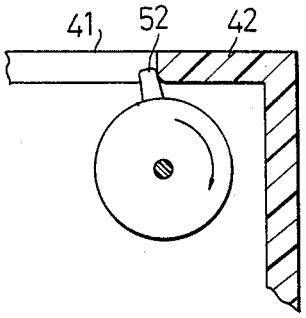

Next, when the hand is removed from the body 10, the rear wheels 18 are rotated by the power derived from the spring, causing the body 10 to start traveling. Thereby, the cam 52 having abutted against the abutment piece 42 is pivoted in the direction opposite to the direction of storing energy by the pivoting force from the gear device 51. When the cam 52 is rotated a little less than one full turn, it abuts against the abutment piece 42 again (see FIG. 6B). At this time, however, torque is continuously applied to the cam 52 since the engagement of the one-way clutch 53 occurs. Therefore, the cam 52 slidably contacts the lower end portion of the abutment piece 42 and gradually pushes up the same until the cam 52 reaches the lower surface of the abutment piece 42 and rotates it. This causes the lock arm 41 to be pushed up against the tension of the spring 45, and the end 44 thereof is released from the lock projection 46.

Figure 5B:
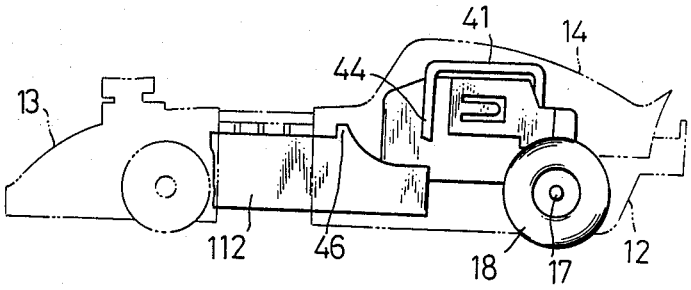
FIG. 5B is a side elevational view showing an elongated state of the vehicle body.

When the lock is thus released, the compressed spring 21 of the urging means 20 elongates while pressing the spring retaining pieces 221, 231 causing the front portion of the body 10 to be pushed forward. As a result, the running toy travels with the body 10 longitudinally elongated or transformed as shown in FIG. 5B. It is to be ntoed that there is not possibility of disconnection of the front and rear lower frame members 11, 12 from each other when the body 10 is in the elongated state, since the lock pawl 126 engages the end portion of the lock groove 116 and is caught thereby as shown in FIG. 4.

Moreover, the running toy in accordance with the invention is provided with a mechanism for locking the body so as not to effect an elongation action and hence can be enjoyed as a normal running toy. The lock is effected by actuating the changeover lever 124 projecting from the lower surface of the rear lower frame member 12 so that the locking hook 125 is engaged by the hook engaging portion 115 provided on the front lower frame member 11.

The following is the description of an example of an addition of vertically moving the exhaust pipes on the running toy in accordance with the above described embodiment.

Figure 7A:
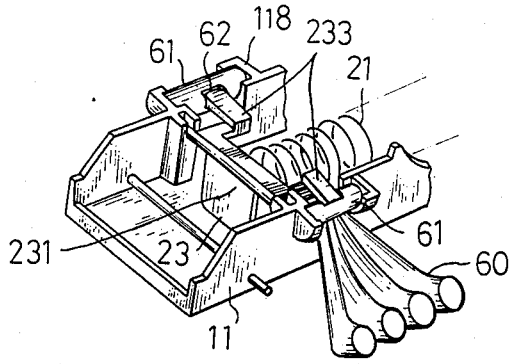
FIGS. 7A and 7B are perspective views showing the vertically movable exhaust pipes attached to the toy in different positions.

The exhaust pipes 60 have at the base thereof a shaft 61 and an abutment portion 62 which abuts against the corresponding pressing piece 233 of the spring retaining member 23 as shown in FIG. 7A. On the other hand, as shown in FIG. 2, the front lower frame member 11 mounting the exhaust pipes 60 is provided with the notches 117 at respective positions with the notches 117 at respective positions on the right and left side surfaces rearward of the front wheels, together with bearings 118 provided around the respective notches 117 for pivotably supporting the shafts 61.

The assembly of the front portion of the body 10 with exhaust pipes 60 is as follows. First, the shafts 61 are fitted in the respective bearings 118 of the front lower frame member 11 to attach the exhaust pipes 60. Next, the spring retaining member 23 and the housing member 13 are attached according to the above described procedure. Then, the front portion of the body 10 is connected to the rear portion of the body 10 which is assembled according to the above described procedure, and moreover, the front and rear portions of the body 10 are pressed toward each other to from them as one body. At this time, the exhaust pipes 60 abut against an edge portion 141 of the rear housing member 14 and are in a downwardly positioned state (see FIG. 7A).

Figure 7B:
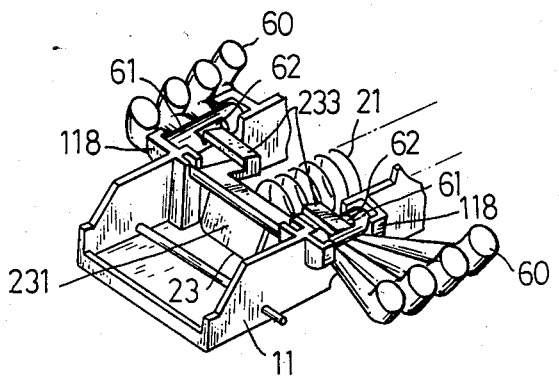

When the toy is run under this state, by the above described action, the body 10 is elongated, causing the rear housing member 14 to separate from the exhaust pipes 60, thereby allowing the exhaust pipes 60 to be pivotable. In the front lower frame member 11, the spring retaining piece 231 of the spring retaining member 23 is being pressed by the spring 21 to generate torque; therefore, the pressing pieces 233 down-wardly press the respective abutment portions 62. Consequently, when the exhaust pipes 60 become pivotable as described above, the pressing pieces 233 downwardly press the abutment portions 62. Accordingly, the exhaust pipes 60 pivot about the respective shafts 61, and the exhaust pipes 60 move to a lifted-up state as shown in FIG. 7B.

As described above, not only the elongation of the body but also the vertical change of the exhaust pipes is provided. Although the case where the invention is applied to a car is shown in the above described embodiment, the invention is also applicable to various running toys.

I claim:

1. A toy vehicle capable of elongated reconfiguration comprising:

a front body portion configured to simulate the front of a vehicle;

a rear body portion configured to simulate the rear of a vehicle;

means for driving the toy vehicle across a support surface;

means interconnecting the front and rear body portions in a movable arrangement on a common longitudinal axis, the front and rear body portions being movable along the longitudinal axis from a position adjacent each other to a position apart from each other whereby the vehicle can assume an elongated vehicle configuration with a space between said body portions, said interconnecting means including means for securing said body portions in said adjacent position and means biasing said body portions toward said apart position;

two sets of simulated motor exhaust pipes connected to the toy vehicle and extending respectively outwardly on each side of the body portions in directions approximately perpendicular to the longitudinal axis;

means for pivotally mounting the sets of exhaust pipes so that they are positioned in a lower initial position when the front and rear body portions are positioned adjacent to each other and are automatically positioned in a relatively higher raised position between the front and rear body portions to provide a more racey appearance when the front and rear body portions are released to be configured in the elongated vehicle configuration; and means associated with said driving means for automatically releasing said securing means to permit said reconfiguration as said vehicle is driven across said support surface.

2. The invention of claim 1 further including locking means to prevent reconfiguration.

3. The invention of claim 1 further including means for biasing the exhaust pipe sets toward a raised position.

4. The invention of claim 3 wherein the rear body is housed by a rear housing having a camming surface for holding the exhaust pipe sets in a biased lower position.

* * * * *